US006883446B2

(12) United States Patent
Koerner

(10) Patent No.: US 6,883,446 B2
(45) Date of Patent: Apr. 26, 2005

(54) QUILTING METHOD AND APPARATUS

(76) Inventor: Ralph J. Koerner, P.O. Box 1320, Ramona, CA (US) 92065

( * ) Notice: Subject to any disclaimer, the term of this patent is extended or adjusted under 35 U.S.C. 154(b) by 0 days.

(21) Appl. No.: 10/776,355

(22) Filed: Feb. 11, 2004

(65) Prior Publication Data

US 2005/0016428 A1 Jan. 27, 2005

Related U.S. Application Data

(60) Provisional application No. 60/447,159, filed on Feb. 12, 2003.

(51) Int. Cl.[7] ..... D05B 69/36

(52) U.S. Cl. ..... 112/272; 112/475.02

(58) Field of Search ..... 112/117, 271, 112/272, 274, 275, 475.02, 277, 470.03; 700/136, 130

(56) References Cited

U.S. PATENT DOCUMENTS

| | | | | |
|---|---|---|---|---|
| 3,609,373 | A | | 9/1971 | Desai |
| 3,799,084 | A | | 3/1974 | Furnari |
| 4,565,140 | A | | 1/1986 | Martell et al. |
| 4,619,214 | A | | 10/1986 | Baruffa et al. |
| 4,658,741 | A | | 4/1987 | Jehle et al. |
| 4,742,789 | A | | 5/1988 | Pestel et al. |
| 4,757,773 | A | | 7/1988 | Nomura et al. |
| 4,982,677 | A | * | 1/1991 | Nomura et al. ..... 112/314 |
| 5,020,460 | A | | 6/1991 | Babson et al. |
| 5,168,822 | A | | 12/1992 | Nufer et al. |
| 5,170,733 | A | * | 12/1992 | Honma et al. ..... 112/308 |
| 5,215,020 | A | | 6/1993 | Pordzik |
| 5,271,345 | A | | 12/1993 | Matschulat et al. |
| 5,370,072 | A | * | 12/1994 | Adamski, Jr. ..... 112/470.03 |
| 5,664,508 | A | * | 9/1997 | Mulcahey et al. ..... 112/2.1 |
| 5,687,660 | A | | 11/1997 | Honda et al. |
| 6,263,815 | B1 | | 7/2001 | Furudate |
| 6,401,641 | B1 | | 6/2002 | Miyano |
| 6,450,110 | B1 | | 9/2002 | Brühl et al. |
| 6,470,813 | B1 | * | 10/2002 | Ebata et al. ..... 112/102.5 |
| 2002/0124781 | A1 | | 9/2002 | Migliorini |
| 2003/0131773 | A1 | | 7/2003 | Schweizer |

FOREIGN PATENT DOCUMENTS

DE 40 37 854 C2 10/1992

* cited by examiner

*Primary Examiner*—Rodney Lindsey
*Assistant Examiner*—Brian Kauffman
(74) *Attorney, Agent, or Firm*—Freilich, Hornbaker & Rosen

(57) ABSTRACT

A quilting apparatus for enabling a user to freely move a stack of fabric layers across a planar bed relative to an actuatable stitch head. The apparatus includes a motion detector which detects the movement of the stack and controls the actuation of the stitch head. Consequently, the apparatus functions to synchronize the delivery of stitch strokes by the head with the manually controlled movement of the quilt material stack. This frees the user to move the stack over a wide range of speeds, to start or stop movement at will, and to guide the stack in any direction across the planar bed.

34 Claims, 15 Drawing Sheets

QUILTING METHOD AND APPARATUS

RELATED APPLICATIONS

This application claims the benefit of U.S. Provisional Application No. 60/447,159 filed 12 Feb. 2003.

FIELD OF THE INVENTION

This invention relates generally to a system for fastening together two or more flexible planar layers and more particularly to a method and apparatus for stitching together two or more fabric layers, as in quilting.

BACKGROUND OF THE INVENTION

Creating decorative quilts by hand has become a popular avocation. A typical quilt is comprised of at least two fabric layers which are stacked and stitched together. Generally the quilt is comprised of a "top" layer, a "bottom" or "backing" layer, and an intermediate "batting" layer. The top layer is typically decorative and is produced as a consequence of the creative and artistic effort of the quilt maker. The backing layer is usually simple and aesthetically compatible with the top. The batting layer generally provides bulk and insulation. The specific process of sewing the sandwich of the three planar layers together is generally referred to as "quilting". The quilting process usually consists of forming long continuous patterns of stitches which extend through and secure the top, backing, and batting layers together. Oftentimes stitch patterns are selected which have a decorative quality to enhance the overall aesthetics. A general goal of the quilting process is to produce precise consistent stitches that are closely and uniformly spaced.

Quilting traditionally has been performed by hand without the aid of a sewing machine. However, hand quilting is a labor-intensive process which can require many months of effort by a practiced person to create a single quilt. Accordingly, it appears that a trend is developing toward using machines to assist in the quilting process to allow most of the quilter's effort to be directed toward the creative and artistic aspects of the top layer.

Machine quilting can be performed in a variety of ways. For example, a user can operate a substantially conventional sewing machine in a "free motion" mode by removing or disabling the machine's feed dogs. This allows the user to manually move the stacked quilt layers relative to the machine's needle, either directly or via a quilt frame, to produce desired patterns of stitches. In practice, the sewing machine is run at a relatively constant speed as the user moves the stacked quilt materials under the needle. This process typically requires significant operator skill acquired after much practice to enable the operator to move the quilt stack in synchronism with the needle stroke to form high quality stitch patterns. Thus, free motion quilting with a conventional sewing machine requires significant user skill and yet frequently yields imperfect results, particularly when forming curved and intricate stitch patterns.

Machine quilting can also be performed by using a wide range of specialized hand guided quilting systems which have become available in recent years. The characteristics and features of such systems are discussed in an article which appeared in *Quilter's Newsletter Magazine* (QNM), April 2003, by Carol A. Thelen. The article identifies three categories of such systems; i.e., (1) Table top set-ups, (2) Shortarm systems, and (3) Longarm systems. They are generally characterized by a table which supports a frame and a quilting/sewing machine. The frame includes rollers which hold the quilt layers so as to enable a portion of the layered stack to be exposed for stitching while the remaining layer portions are stored on the rollers. The quilting/sewing machine rests on a carriage mounted for movement (e.g., along tracks) relative to the frame and table. The carriage is generally provided with handles enabling an operator to move the machine over the surface of the quilt. The QNM article further discusses optional add-ons and accessories enabling various electronic functions, including stitch regulation, to be added to basic shortarm or longarm systems.

SUMMARY OF THE INVENTION

The present invention is directed to a system for fastening together two or more flexible planar layers and more particularly to a quilting method and apparatus for enabling a user to readily produce uniform stitches for fastening together a stack of fabric layers.

Apparatus in accordance with the invention permits a user to freely manually move a stack of planar layers across a planar bed, or plate, beneath an actuatable stitch head. The apparatus includes a detector for detecting the movement of the stack proximate to the stitch head for controlling actuation of the stitch head. Consequently, an apparatus in accordance with the invention functions to automatically synchronize the delivery of stitch strokes to the movement of the stack. This enables the user to move the stack within a wide range of speeds, to start or stop the stack movement at will, and to guide the stack in any direction across the planar bed.

More particularly, a preferred apparatus in accordance with the invention includes a detector configured to detect stack movement within the throat space of a quilting/sewing machine by measuring the movement of at least one surface of the stack as it moves across the planar bed. Stack movement is preferably measured by determining translation of the stack along perpendicular X and Y directions.

Preferred embodiments of the invention employ a detector capable of measuring stack surface movement without physically contacting the stack. A preferred detector in accordance with the invention responds to energy e.g., light, reflected from a surface of the stack as it moves across the planar bed. The detector preferably includes a detection window located to collect reflected energy from a target area coincident with the stack surface (top and/or bottom) within the machine's throat space.

In a specific preferred embodiment, an optical detector is employed to provide output pulses representative of incremental translational movement of the stack along perpendicular X and Y directions. The output pulses are then counted to determine the distance the stack has moved. When the magnitude of movement exceeds a predetermined magnitude or threshold, a "stitch stroke" command is issued to cause the stitch head to insert a stitch through the stacked layers. As the user continues to freely move the stack across the planar bed, additional stitch stroke commands are successively issued to produce successive stitches synchronized with the user controlled stack motion.

In accordance with one aspect of the preferred embodiment, the stitch head is configured to rapidly execute a single stitch cycle in response to each stitch stroke command. More particularly, the head is preferably configured so that its needle is held in its full up position between stitch cycles to avoid obstructing the user's freedom of movement for the stack. During each stitch cycle, a needle drive mechanism causes the needle to rapidly drop to pierce the stack layers on the bed, insert a stitch, and then rapidly rise back to its full up position to await the next stitch stroke command.

Although a single stitch mode, or impulse mode, of operation is advantageous to enable a user to operate at slow stack speeds (preferably down to zero), at higher stack speeds, e.g., greater than 20 inches per minute, it is generally satisfactory to control the speed of a continuously running needle drive motor so as to be proportional to the speed of stack movement.

In accordance with another aspect of a preferred embodiment, a stack hold-down plate or "presser foot" is associated with the stitch head. During a stitch cycle, the presser foot holds the stack against the bed to assure proper stitch tension and facilitate the needle's upward movement out of the stack. Between stitch cycles, the force on the presser foot is relieved to allow the stack to be freely moved through the machine's throat space between the presser foot and the planar bed.

Although the preferred embodiments to be described herein comprise machines in which the elements of the invention are fully integrated, it is pointed out that alternative embodiments can adapt conventional sewing machines to operate in accordance with the present invention.

DETAILED DESCRIPTION

Figure 1:
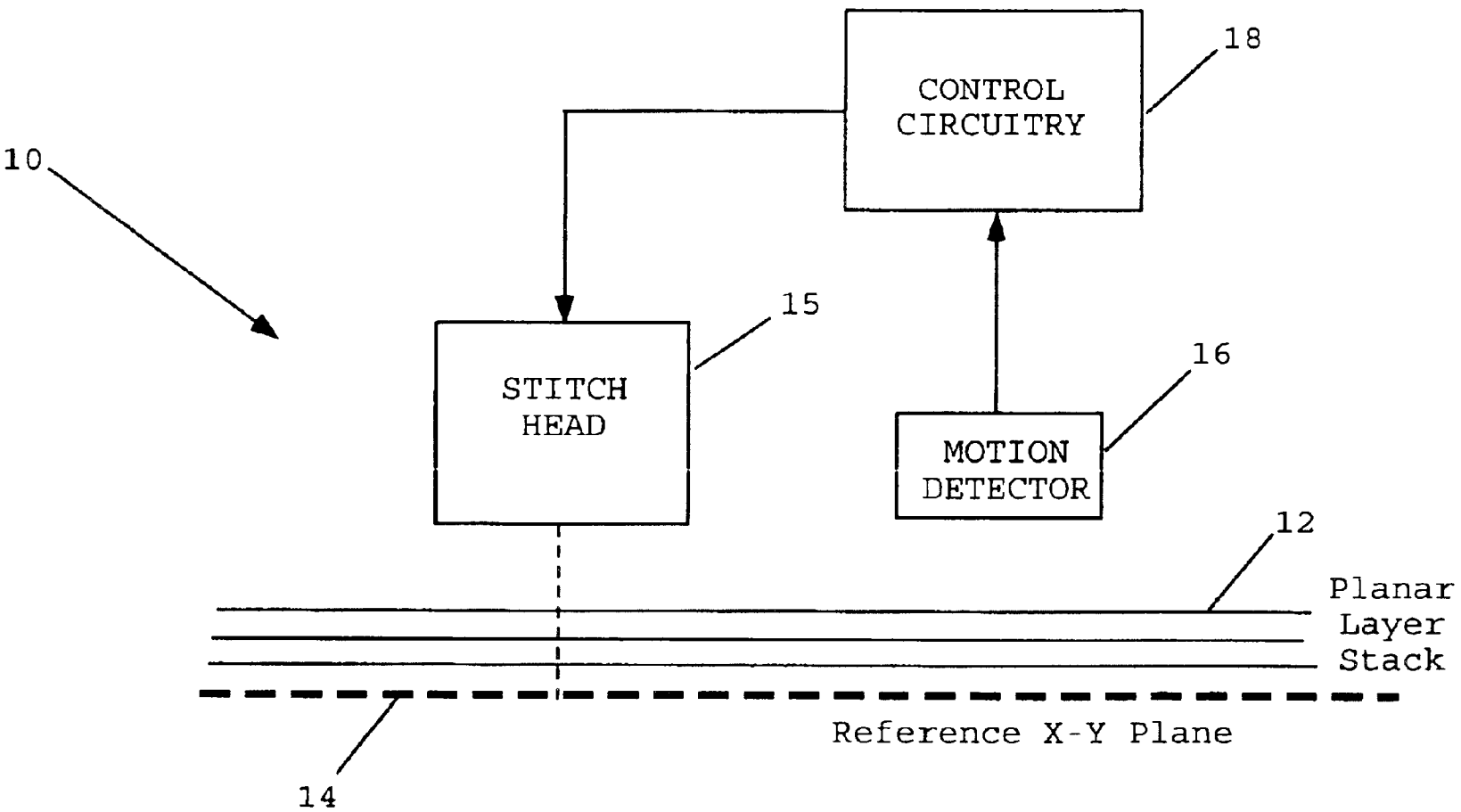
FIG. 1 is a block diagram of a quilting system in accordance with the invention for fastening stacked planar layers.

Attention is initially directed to FIG. 1 which depicts a generalized system 10 in accordance with the invention for fastening together two or more flexible planar layers forming a stack 12. The stack 12 is supported for guided free motion along a reference X-Y plane 14 proximate to a fastening, or stitch, head 15. The head 15 is actuatable to insert a fastener, or stitch, through the stacked layers 12 to fasten the layers together. A motion detector 16 is provided to sense the movement of stack 12 across plane 14. Control circuitry 18 responds to increments of stack movement to actuate the head 15 to insert uniformly spaced fasteners or stitches through the layers of stack 12. As Will be described hereinafter, the detector 16 is preferably configured to measure the stack translational motion along perpendicular X, Y axes of reference plane 14 proximate to the stitch head 15.

Figure 2:
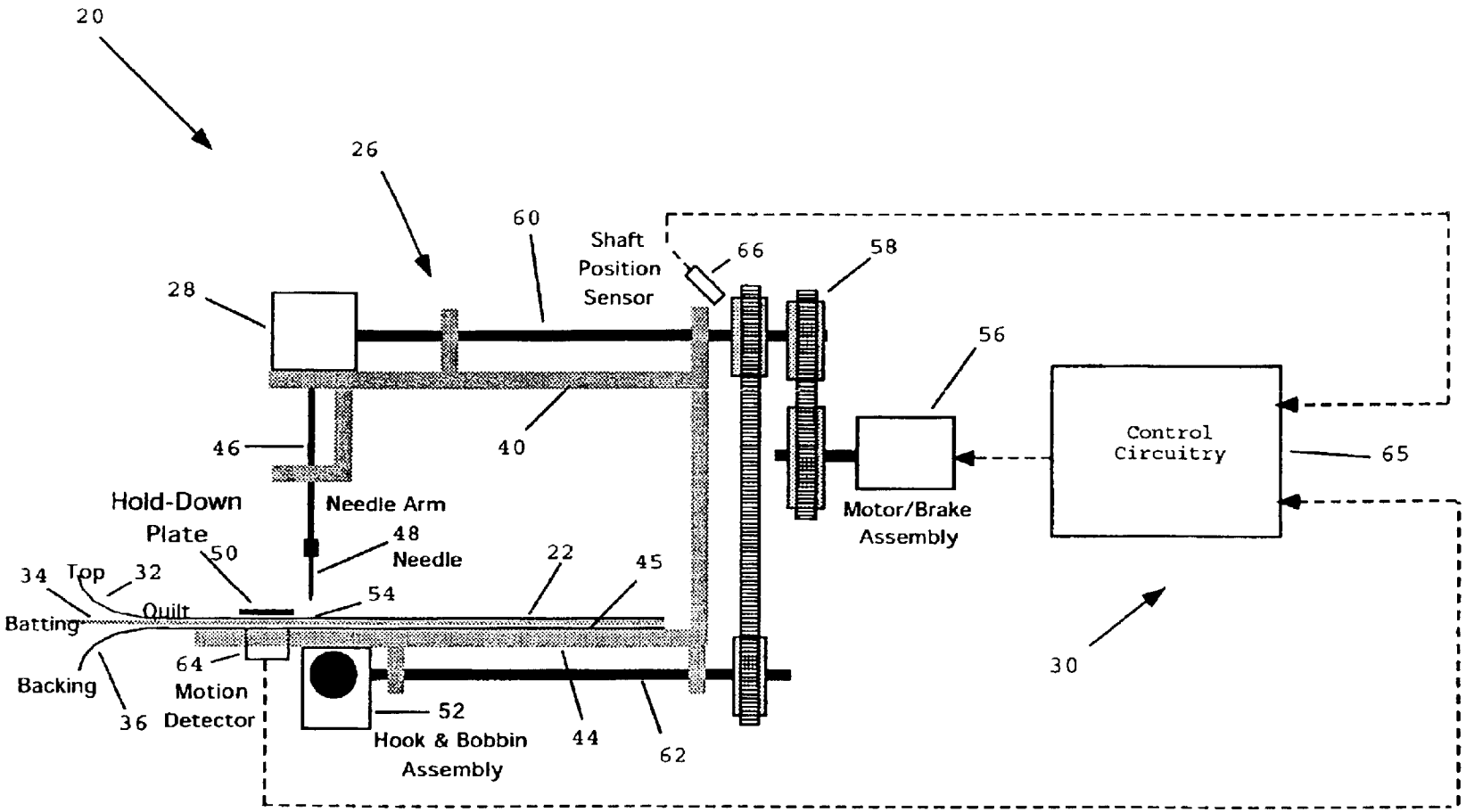
FIG. 2 is a diagrammatic illustration of a first embodiment of the invention utilizing a motor/brake assembly to control the stitch head.

FIG. 2 illustrates a first preferred embodiment 20 of the system of FIG. 1 for stitching together fabric layers of a stack 22. The embodiment 20 is generally comprised of a mechanical machine portion 26, including an actuatable stitch head 28, and an electronic control subsystem 30 for actuating the head 28 in response to movement of the stack 22. Although the planar layers of stack 22 can consist of a wide variety of materials intended for different applications, the preferred embodiments to be discussed hereinafter are particularly configured for stitching together fabric layers, e.g., a top layer 32, an intermediate batting layer 34, and a bottom backing layer 36, to form a quilt.

The machine portion 26 of FIG. 2 is generally comprised of a frame 40 configured to support the stitch head 28 above a bed 44 providing a substantially horizontally oriented planar surface 45. The stitch head 28 includes a needle bar 46 supporting a needle 48 for reciprocal vertical movement essentially perpendicular the planar surface 45. The bed surface 45 is configured for supporting the layered stack 22 so as to enable a user to freely manually guide the stack 22 across the surface 45. A hold-down plate, or presser foot, 50 is provided to selectively press the stack 22 against the bed surface, as will be explained hereinafter, to assure proper stitch tension and to assist the needle to pull upwardly out of the stack after inserting a stitch.

Figure 4:
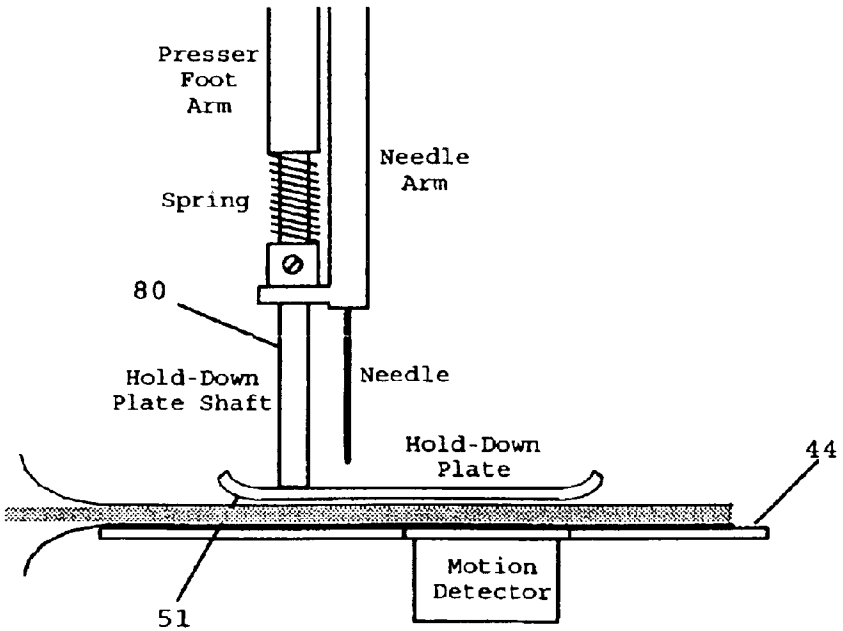
FIGS. 3 and 4 are diagrammatic illustrations respectively showing the hold-down plate of FIG. 2 in its actuated and non-actuated positions.

A conventional hook and bobbin assembly 52 is mounted beneath the bed 44 in alignment with the needle 48. The stitch head 28 including needle bar 46 and needle 48, operates in a substantially conventional manner in conjunction with the hook and bobbin assembly 52 to insert a stitch through the stack 22 at a fixedly located opening, or stitch site, 54 on the bed. During a stitch cycle when the needle 48 is lowered to its down position to pierce the stack layers (FIG. 3), the hold-down plate 50 is also lowered to press the stack layers against the bed 44 to achieve proper stitch tension and assist the needle to pull up out of the stack. After completion of a stitch cycle, the needle 48 and hold-down plate 50 are raised (FIG. 4). As will be discussed hereinafter, the raised position of the hold-down plate (FIG. 4) is preferably selected to loosely bear against the stack to maintain the backing layer 36 (FIG. 2) against the bed 44 to assure detection by detector 16 while also permitting the stack to be freely moved across the bed 44.

The preferred machine portion 26 of FIG. 2 is further depicted as including a motor/brake assembly 56 which functions to selectively provide operating power and braking via a suitable transmission system 58 to an upper drive shaft 60 and a lower drive shaft 62. The upper drive shaft 60 transfers power from the motor/brake assembly 56 to stitch head 28 for moving the needle 48. The lower drive shaft 62 transfers power from the motor/brake assembly 56 to the hook and bobbin assembly 52.

The stitch head 28 and hook and bobbin assembly 52 operate cooperatively in a conventional manner to insert stitches through the layers of stack 22 at stitch site 54. That is, when the stitch head cycle is initiated, needle 48 is driven downwardly to pierce the stacked layers 32, 34, 36 and carry an upper thread (not shown) through the stitch site opening 54 in bed 44. Beneath the bed 44, the hook (not shown) of assembly 52 grabs a loop of the upper thread before the needle 48 pulls it back up through the stack which is held down by presser foot 50. The upper thread loop grabbed by the hook is then locked by, a thread pulled off the bobbin (not shown) of assembly 52.

The system of FIG. 2 includes a transducer, or detector, 64 for detecting the movement, or more specifically, the translation of the stack 22 on bed 44 for controlling the motor/brake assembly 56 via control circuitry 65. As will be discussed in greater detail hereinafter, in operation, a user is able to freely move the layered stack 22 on bed 44 relative to the fixedly located stitch head 28 while the detector 64 produces electronic signals representative of the stack movement. Control circuitry 65 then responds to the detected stack movement for controlling the issuance of a stitch from head 28. The control subsystem 30, in addition to including motion detector 64 and control circuitry 65, also preferably includes a shaft position sensor 66. The shaft position sensor 66 functions to sense the particular rotational position of the upper drive shaft 60 corresponding to the needle 48 being in its full up position. As will be seen hereinafter, the control circuitry 65 responds to the output of sensor 66 to park the needle 48 in its full up position between successive stitch cycles. This action prevents the needle from interfering with the free translational movement of the stack 22 on bed 44.

In accordance with the invention, an operator guides a fabric stack across the horizontally oriented bed 44 beneath the vertically oriented needle 48. The motion detector 64 in accordance with the invention is mounted to monitor a target area coincident with a surface layer (top and/or bottom) of the stack 22 as the stack is moved across the bed 44. As will be discussed hereinafter, the detector can be considered as having a window focused on the stack surface proximate to the needle penetration site. The detector can be variously physically mounted; e.g., above the stack looking down at the stack top surface or below the stack looking up at the stack bottom surface.

Although the motion detector 64 of FIG. 2 can take many different forms, including both noncontacting devices (e.g., optical detector) and contacting devices (e.g., track ball), it is much preferred that it detect stack movement without physically contacting the fabric layers. Accordingly, a preferred motion detector in accordance with the invention comprises a device for responding to energy reflected from, or sourced by, the stack. Although this energy can be of several different forms (e.g., ultrasonic, RF, magnetic, electrostatic, etc.), the preferred detector embodiment employs an optical motion detector (represented in FIG. 8) utilizing, for example, an optical chip ADNS2051 marketed by Agilent Technologies. Alternative detectors for measuring stack can employ technologies such as accelerometers, resistive devices, etc.

Figure 3:
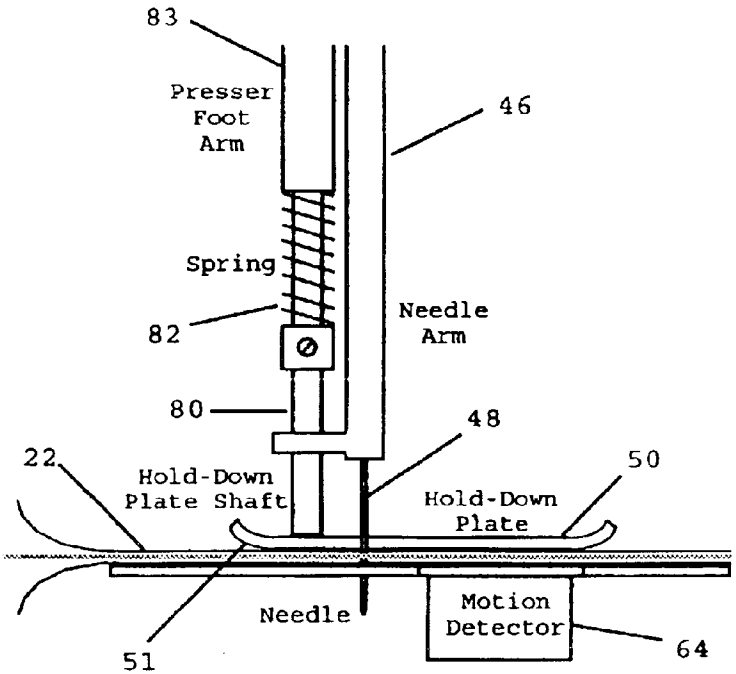

Suffice it to say at this point that the accurate measurement of stack movement depends, in part, upon the stack target layer, e.g., backing layer 36, being positioned near the focus of the motion detector window. The aforementioned hold-down plate or presser foot 50 assists in maintaining the stack layers at a certain distance from the detector window. In a preferred embodiment, the hold-down plate 50 has a flat smooth bottom surface 51 for engaging the stack 22 and is fabricated of transparent material to avoid obstructing a user's view of the stack layers proximate to the needle 48. FIGS. 3 and 4 respectively illustrate the actuated and non actuated positions of the hold-down plate 50. In FIG. 3, shaft 80 is moved down during the stitch cycle to cause the plate 50 to apply spring pressure, attributable to spring 82, to the stack 22. Between cycles (FIG. 4), shaft 80 is moved up so the pressure of plate 50 against stack 22 is relieved to reduce motion-inhibiting friction of the plate against the stack. Nevertheless, during a non-stitch interval between cycles, the plate 50 is positioned closely enough to loosely hold the stack against the bed 44.

Note in FIGS. 3 and 4 that the hold-down plate 50 is attached to shaft 80 that slides, loaded by spring 82, up and down, relative to a presser foot arm 83. Also note that FIG. 4 shows the needle arm 46 assisting to pull the spring-loaded shaft 80 upwardly. The travel range of the hold-down plate 50 permits free horizontal motion of the quilt stack across the bed between stitch cycles but constrains vertical motion of the stack sufficiently to assure that the backing layer surface 36 is held against the bed surface and near the focus of the window of motion detector 64.

Figure 5:
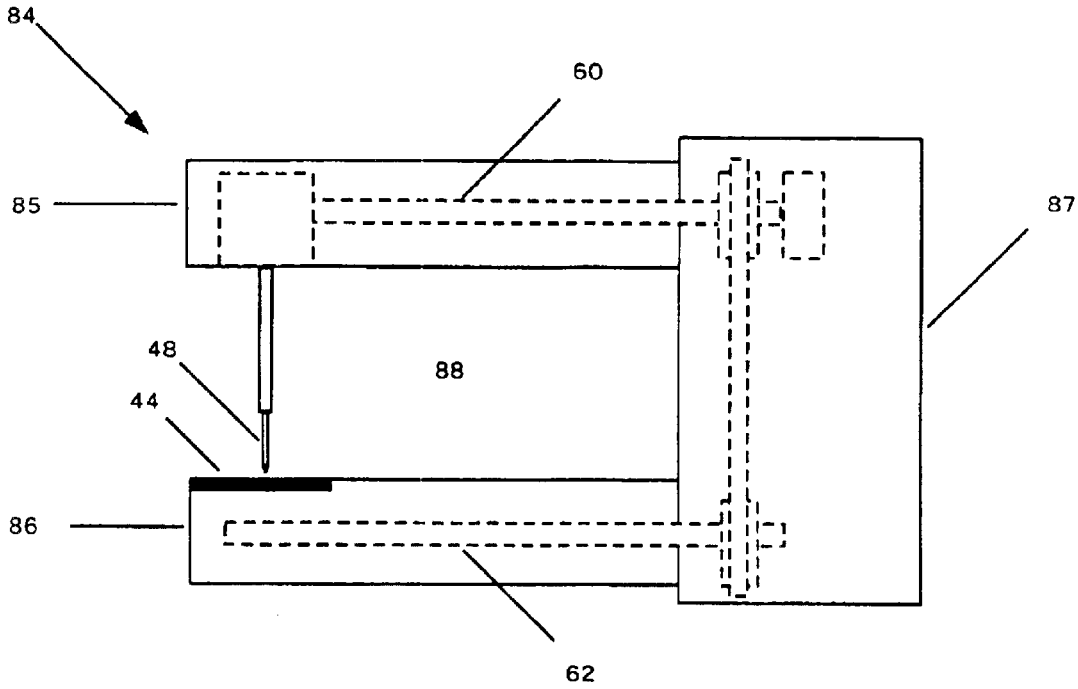
FIGS. 5 and 6 respectively show side and end views of an exemplary quilting/sewing machine housing.
Figure 6:
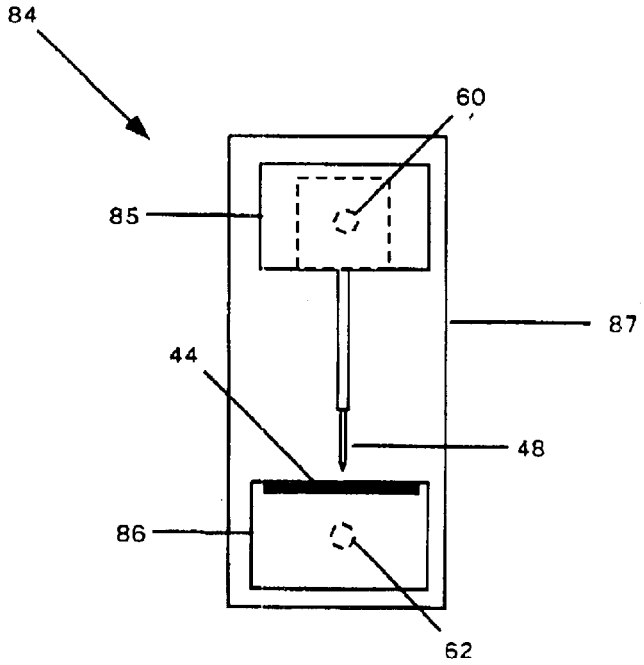

FIGS. 5 and 6 schematically depict a typical quilting/sewing machine housing 84 for accommodating the physical components of the system of FIG. 2. The housing 84 comprises an upper arm 85 which contains the upper drive shaft 60 and a lower arm 86 containing the lower drive shaft 62. The housing upper and lower arms 85 and 86 extend from a vertically oriented machine arm 87. The upper and lower arms 85, 86 are vertically spaced from one another and together with the machine arm 87 define a space which is generally referred to as the throat space 88. The needle 48 descends vertically from the upper arm into the throat space 88 for reciprocal movement toward and away from the lower arm 85. The lower arm 85 carries the bed 44 which is sometimes referred to as the throat plate. The distance between the needle and the machine arm is generally referred to as the throat length.

Figure 8:
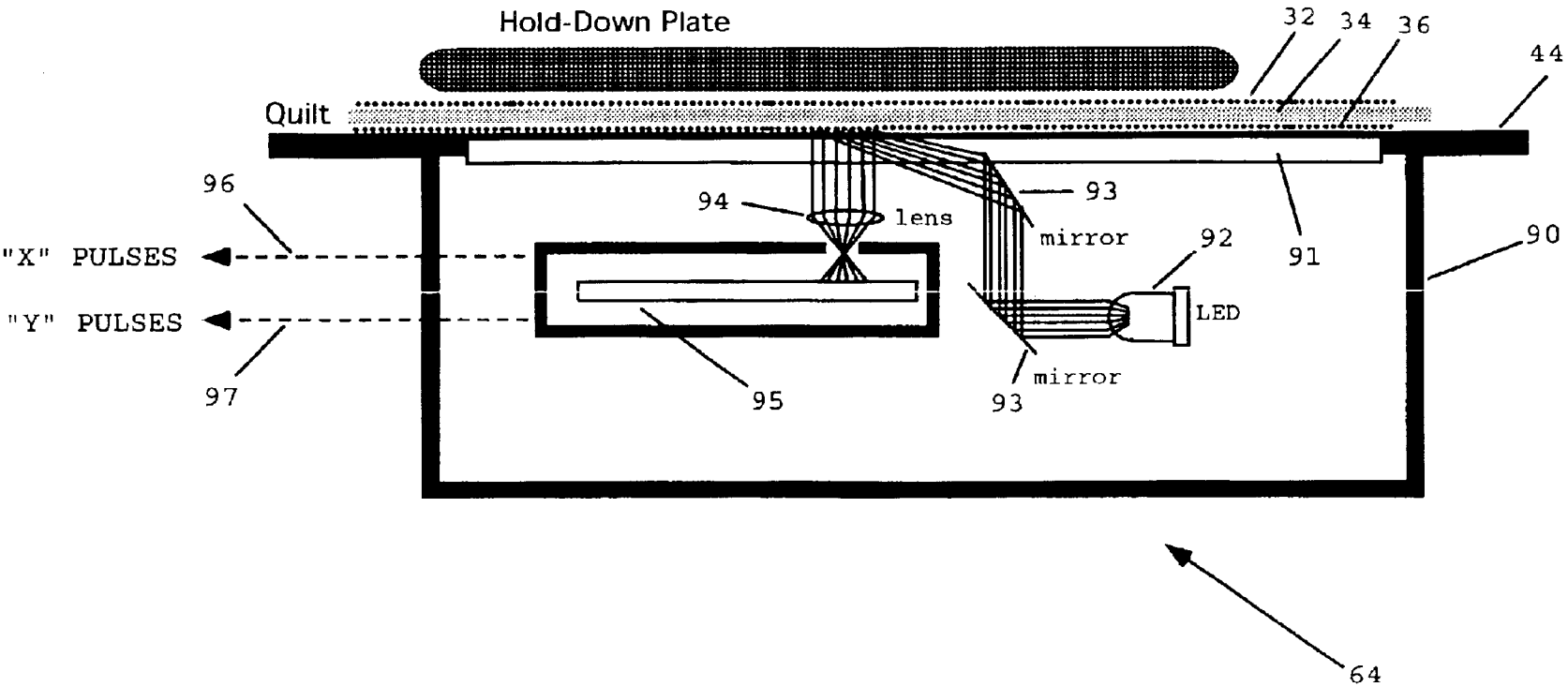
FIG. 8 is a schematic illustration depicting a first optical motion detector embodiment for use in the systems of FIGS. 2 and 7.

FIG. 8 depicts a preferred motion detector 64 comprising a housing 90 having a light collecting window 91. A light source, e.g., a light-emitting diode (LED) 92, is mounted in housing 90 and illuminates (via mirrors 93 and window 91) a target area coincident with the surface of backing layer 36 just above window 91. The light reflected from layer 36 is collected by a lens system 94 and is applied to the optical chip 95 (e.g., Agilent ADNS 2051). The chip 95 internally includes both a tiny CMOS array camera (not shown) which successively acquires images from the target area at about 1500 pictures per second and an associated digital signal processor or DSP (not shown). The signal processor operates at several million instructions per second to detect patterns in the acquired images and to determine, based on changes in a sequence of successive images, how those patterns have moved. As a consequence, the chip 95 is able to provide output pulses on lead 96 representative of incremental translation of the backing layer 36 portion coincident with the target area in an X direction and output pulses on lead 97 representative of incremental translation of the backing layer 36 in a Y direction.

Figure 7:
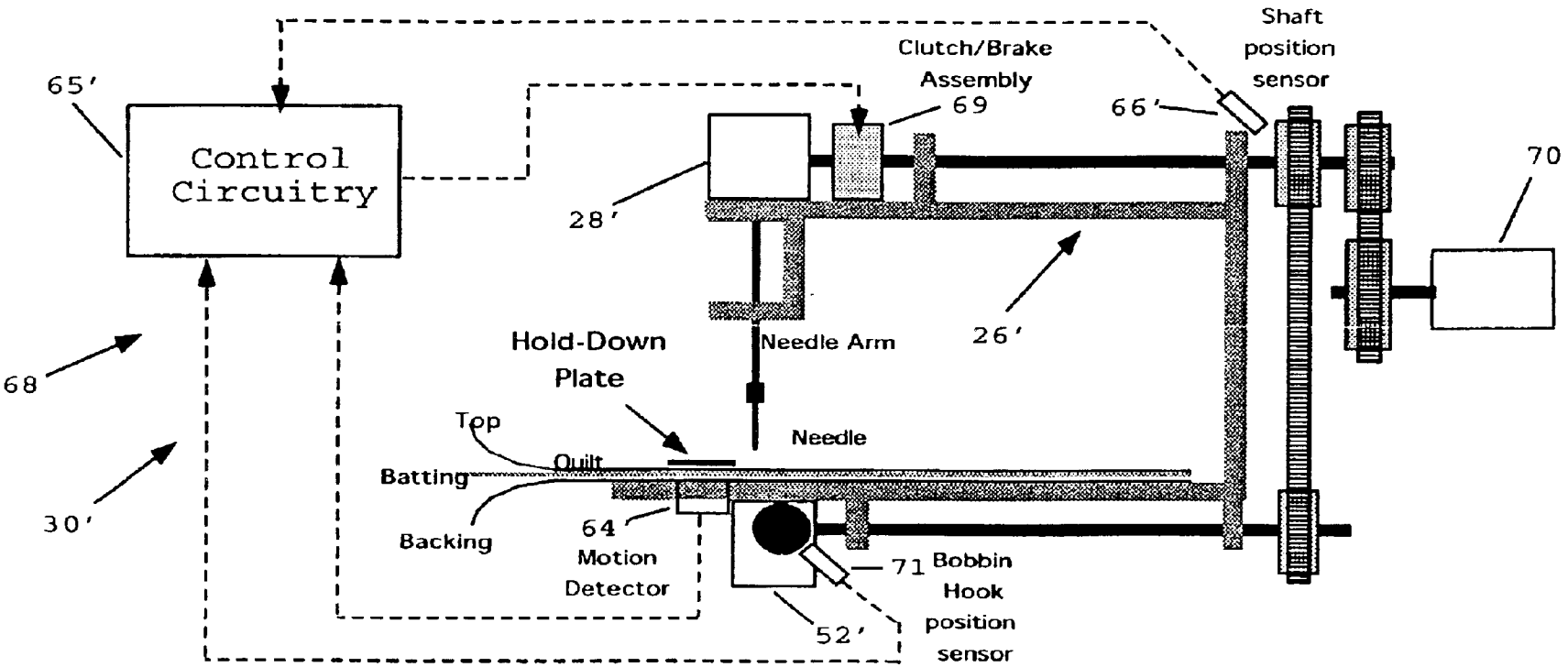
FIG. 7 is a diagrammatic illustration of a second embodiment of the invention, similar to FIG. 2, but utilizing a clutch/brake assembly to control the stitch head.

FIG. 7 illustrates a second alternative system embodiment 68 which contains a mechanical machine portion 26' and an electronic control subsystem 30', similar to the corresponding portions 26 and 30 of the embodiment of FIG. 2. However, the embodiment of FIG. 7 differs from FIG. 2 primarily in that it uses a clutch/brake assembly 69 to control power transfer from motor 70 to the stitch head 28', in lieu of the aforementioned motor/brake assembly 56 of FIG. 2. Additionally, the hook and bobbin assembly 52' in FIG. 7 is driven continuously by motor 70 with the position of the bobbin hook (not shown) therein being sensed by a hook position sensor 71. The outputs of stack motion detector 64', shaft position sensor 66', and hook position sensor 71 are all applied as inputs to control circuitry 65' whose output controls the clutch/brake assembly 69 to selectively actuate the stitch head 28'.

Figure 9:
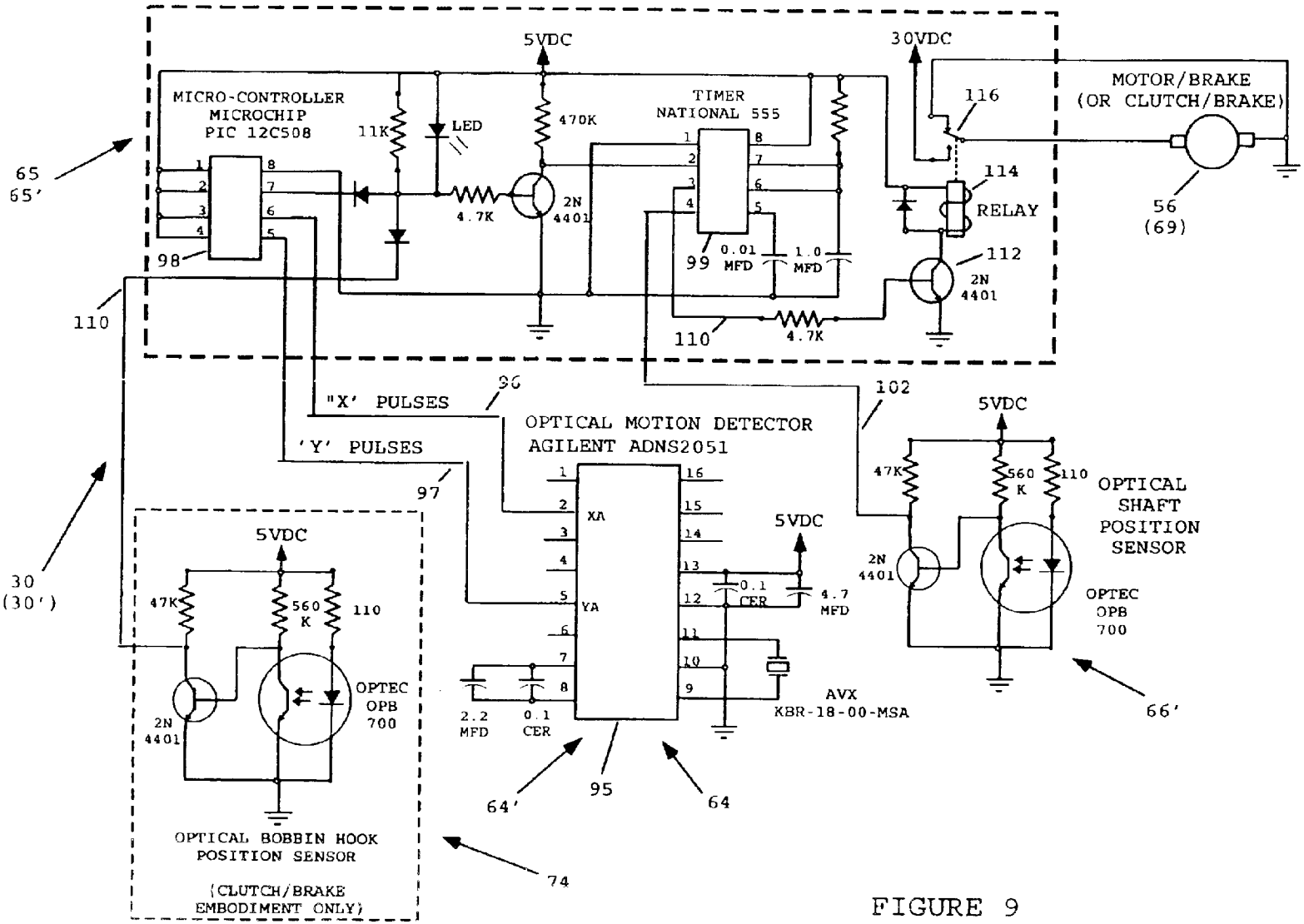
FIG. 9 is a schematic diagram of a control subsystem employing the detector of FIG. 8 for use in the embodiments of FIGS. 2 and 7.

Attention is now directed to FIG. 9 which depicts a circuit diagram relevant to both the control subsystem 30 of FIGS. 2 and 30' of FIG. 7. Note that FIG. 9 shows the optical motion detector 64 (64') and the shaft position sensor 66 (66') which are relevant to both FIGS. 2 and 7. Detector 64 (64') and sensor 66 (66') are connected to provide data signals to control circuitry 65 (65') which is comprised primarily of a controller 98 (e.g., microcontroller chip Microchip PIC 12C508) and a timer circuit 99 (e.g., National 555). FIG. 9 also depicts in dashed line the hook position sensor 74 of FIG. 7 which provides a signal to timer 99 when the hook (not shown) reaches an active position. The shaft position sensor 66 (66') and hook position sensor 74 preferably comprise devices which respond to optical stimuli respectively carried by shaft 60 and the hook of assembly 72, to produce signals for application to the control circuitry. Such optical stimuli would most typically comprise differentially reflective markers respectively placed on the upper drive shaft 60 and the hook of assembly 72. In operation, the microcontroller 98 functions to count output pulses provided by motion detector chip 95 on leads 96 and 97 which respectively represent increments of movement of the quilt backing layer 36 along orthogonal X and Y axes. When the microcontroller 98 recognizes a sufficient cumulative movement, it issues a signal to timer circuit 99. Alternatively, in the particular case of the clutch/brake embodiment of FIG. 7, the microcontroller signal is gated by the output of hook position sensor 74 so that it is applied to the timer circuit 99 only when the bobbin hook is in the desired position. The timer circuit 99 applies the stitch command signal on output 110 to load transistor 112. Transistor 112 controls relay 114 which is shown as operating a single pole double, throw switch 116. In the actuated, lower, position as depicted in FIG. 9, switch 116 applies power to drive the motor of motor/brake assembly 56 of FIG. 2 or alternatively, engages the clutch of clutch/brake assembly 69 of FIG. 7. The relay 114 is deactuated via the timer 98 and the transistor 112 by a pulse on line 102 from the shaft position sensor 66. In the deactuated, upper, position as depicted in FIG. 9, switch 116 closes a shunt path to thus brake the drive train.

Figure 10:
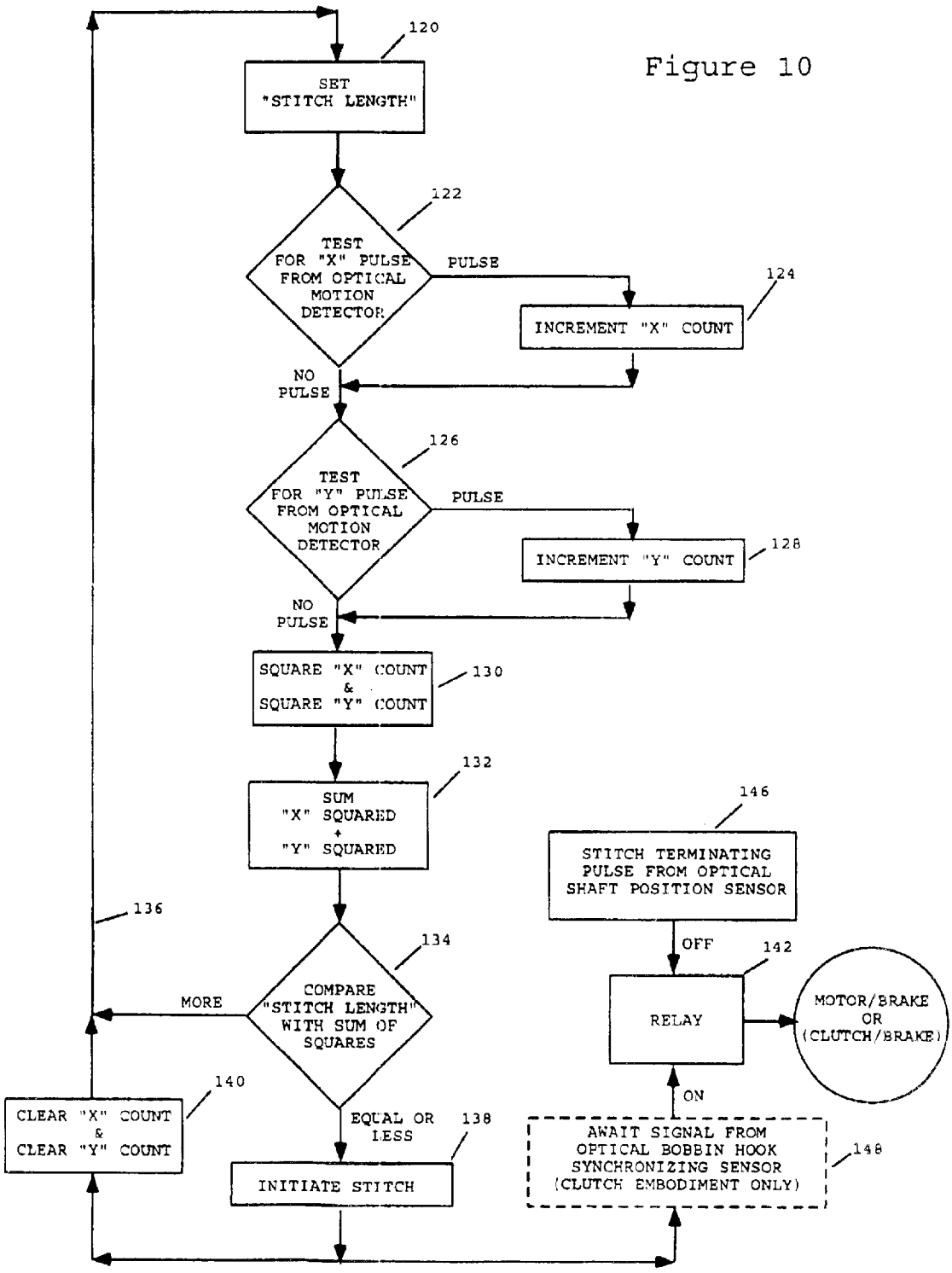
FIG. 10 is a flow chart depicting the operation of the controller of FIG. 9 in a single stitch, or impulse mode.

Attention is now directed to FIG. 10 which comprises a flow diagram depicting the algorithmic operation of microcontroller 98 for controlling the motor/brake assembly 56 of FIG. 2 or the clutch/brake assembly 69 of FIG. 7 to produce a single stitch. In FIG. 10, first note block 120 which functions to initialize a stitch cycle by acquiring a "stitch length" value which typically was previously entered via a user input. With the stitch length value set in block 120, the algorithm proceeds to decision block 122 which tests for stack translation in the X direction, i.e., for an X pulse on lead 96 from the optical chip 95. If a pulse is detected, then a store X count is incremented, as represented by block 124. After execution of blocks 122, 124, operation proceeds to decision block 126 which tests for Y translation, i.e., for a Y pulse on lead 97 of the optical motion chip 95. If a Y pulse is detected, then a stored Y count is incremented as represented by block 128. Operation then proceeds from blocks 126 or 128 to block 130. Blocks 130 and 132 essentially represent steps for determining the resultant stack movement magnitude attributable to the measured X and Y components of motion utilizing the Pythagorean theorem. That is, in block 130, the X count value is squared and the Y count value is squared. Block 132 sums the squared values calculated in block 130 to produce a value representative of the resultant stack movement.

Block 134 compares the square of the preset switch length value with the magnitude derived from block 132. If the magnitude of the resultant movement is less than the preset stitch length, then operation cycles back via loop 136 to the initial block 120. If on the other hand, the resultant magnitude exceeds the preset stitch length, then operation proceeds to block 138 to initiate a stitch. In block 140, the X and Y counts are cleared before returning to the initial block 120. Additionally, after block 138, the relay (114 in FIG. 9) is energized by execution of block 142 to actuate the motor/brake assembly 56 (FIG. 2) or the clutch/brake assembly 69 (FIG. 7). Note, however, that termination of block 142 requires a terminating pulse from the shaft position sensor (represented by block 146) indicating that the upper drive shaft has reached the position to park the needle in its full up position. FIG. 10 also depicts a dashed block 148 between blocks 138 and 142. Block 148 is relevant to the embodiment of FIG. 7 and indicates that the execution of block 142 is deferred until receipt of an enabling signal from the hook position sensor 74 of FIG. 9.

Figure 11A:
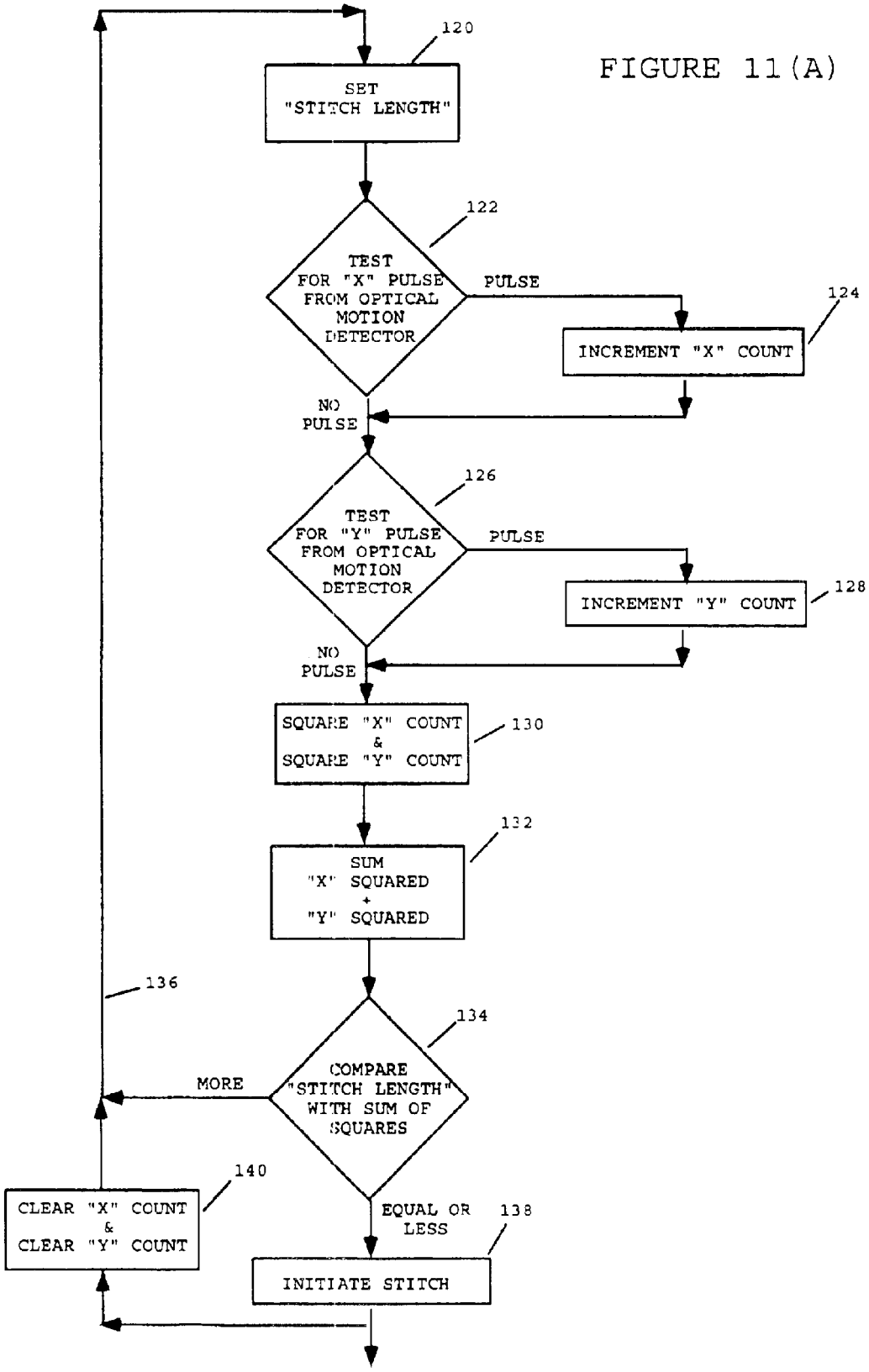
FIG. 11 (presented as 11(A) and 11(B)) comprises a flow chart similar to FIG. 10 but depicting dual mode operation, i.e., (1) impulse mode and (2) proportional mode.
Figure 11B:
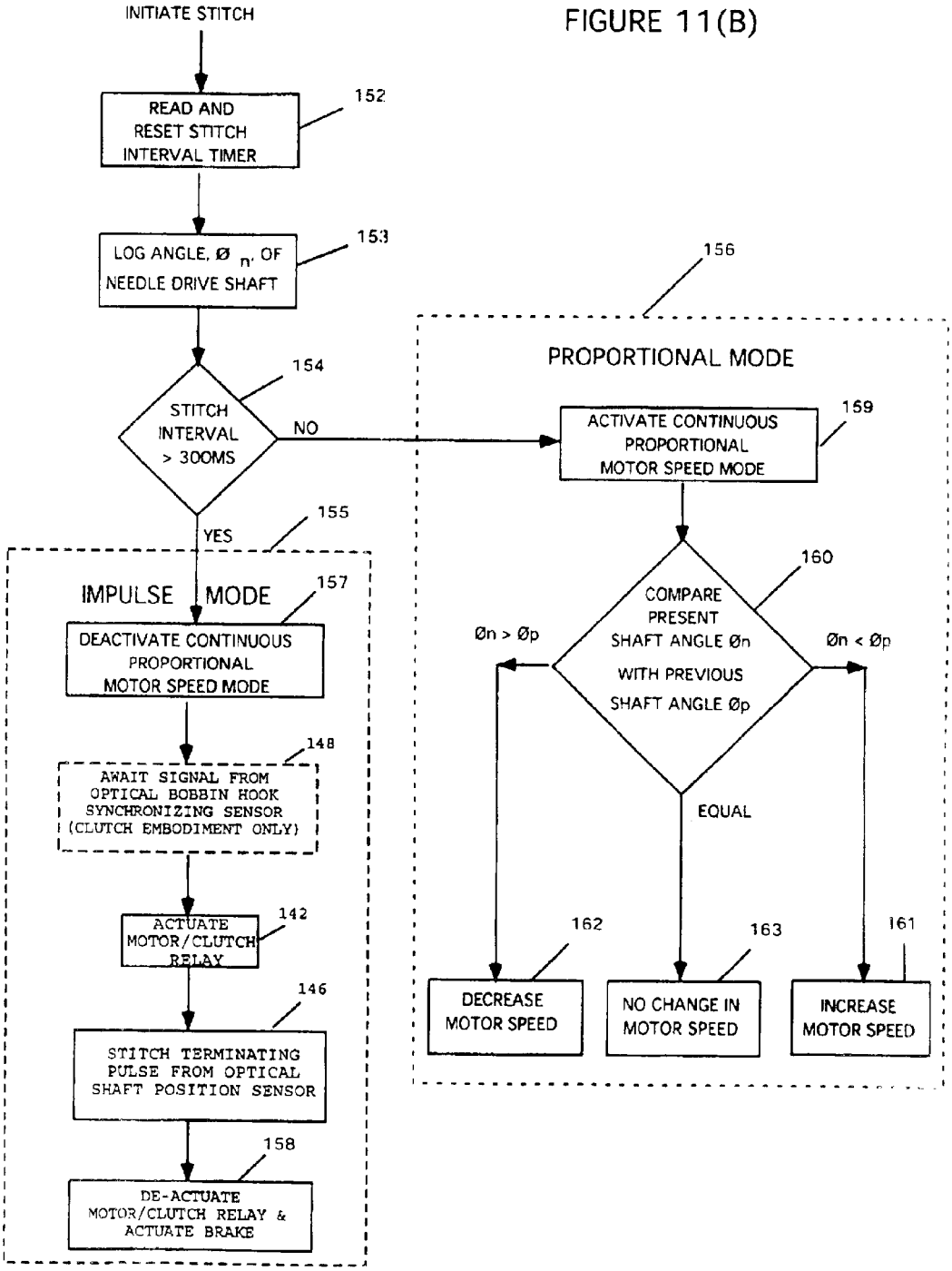

Whereas FIG. 10 depicts the algorithm for operation in the impulse, or single stitch, mode, FIG. 11 (presented as 11(A) and 11(B)) depicts dual mode operation, i.e., impulse mode at slow stack speeds and a continuous proportional mode at higher stack speeds. It is preferable to provide such a dual mode capability to be able to operate more smoothly at higher stack speeds. By way of explanation, it will be recalled that in order to accommodate slow stack speed operation, e.g., less than 20 inches per minute, it is desirable that each stitch command initiate a very rapid needle stroke to avoid the needle interfering with stack movement. As the stack translation speed and needle stroke rate increase, the needle's interference with stack movement diminishes. Thus, at fast stack speeds, e.g., greater than 20 inches per minute (or 200 stitches per minute assuring an exemplary 0.1 inch stitch length), it is appropriate to switch to a proportional mode in which the needle is continuously driven at a rate substantially proportional to stack speed. At a speed of 200 stitches per minute, each needle cycle consumes less than about 300 milliseconds. Accordingly, the algorithm depicted in FIG. 11(B) includes a step which tests for the time duration between successive stitch commands, i.e., a stitch time interval. If the duration of this interval is less than an exemplary 300 milliseconds, then operation proceeds in the proportional mode. An alternative embodiment of the invention (not shown) could operate solely in the proportional mode.

Note that FIG. 11(A) is identical to FIG. 10 through the stitch command or "Initiate Stitch" block 138. FIG. 11(B) shows that block 138 is followed by block 152 which reads and resets a stitch interval timer (which can be readily implemented by a suitable microcontroller) which times the duration between successive stitch commands and records the angular position $\theta_n$ of the needle drive shaft 60 (block 153). Decision block 154 then tests the interval timer duration previously read in block 152 to determine whether it is greater than the aforementioned exemplary 300 millisecond interval. If yes, operation proceeds to the impulse mode 155. If no, operation proceeds to the proportional mode 156.

Operation in the impulse mode 155 is essentially identical to the operation previously described with reference to FIG.

10 with regard to blocks 142, 146, 148. However, FIG. 11(B) additionally shows a block 157 in the impulse mode which can be executed to assure deactivation of the proportional mode and block 158 which deactuates a motor/clutch relay and actuates a brake after a stitch is delivered to park the needle in its up position.

Operation in the proportional mode 156 includes step 159 which activates motor speed control operation. A motor speed control capability is a common feature of most modern sewing machines with motor speed being controlled by the user, e.g., via a foot pedal, and/or by built-in electronic control circuitry.

After block 159, decision block 160 is executed. To understand the function of decision block 160, it must first be recognized that as stack speed is increased, thus generating shorter duration stitch intervals, the shaft angle position $\theta_n$ read in block 153 will decrease, in the absence of an adjustment of motor/needle shaft speed. In other words, a newly read shaft angle $\theta_n$ will be smaller than a previously read shaft angle $\theta_p$. Block 160 functions to compare $\theta_n$ and $\theta_p$ if stack speed increases. If $\theta_n$ is smaller, the motor speed must be increased (block 161) to deliver stitches at an increased rate to maintain stitch length uniformity.

On the other hand, if stack speed is reduced so that en is greater than $\theta_p$, motor speed is decreased (block 162) in order to produce uniform length stitches. If stack speed remains constant, then $\theta_n$ equals $\theta_p$ and no motor sped adjustment is called for (block 163).

From the foregoing, the operation of the systems of FIGS. 2 and 7 in accordance with the invention should be readily appreciated. By way of summary, it should be understood the system enables a user to freely translate the layered stack 22 over the bed 44. The detector 64 senses the movement of the stack to produce X and Y pulses representative of incremental translational movement with respect to orthogonal X and Y axes. The microcontroller 98 (FIG. 9) functions to count the X and Y pulses and determine when the resultant movement is at least equal to the preset stitch length. When this occurs, relay 114 is actuated to supply power via switch 116 to the motor/brake assembly 56 of FIG. 2 (or the clutch/brake assembly of FIG. 7) to initiate a single stitch stroke. That is, actuation of relay 114 throws switch 116 to its lower position (FIG. 9), thus causing the motor to spin up rapidly to transfer power to stitch head 28 and the hook and bobbin assembly 52. The upper and lower shafts 60, 62 rotate until the upper shaft marker passes under the shaft position sensor 66. When the shaft marker is detected, switch 116 is thrown to its upper position thus removing power to the motor/brake assembly 56 and shunting the assembly to quickly arrest the motion of, i.e., brake, the rapidly turning shafts. In order to assure free movement of the quilt stack, the shaft marker is placed so as to stop the needle in its full up position. To further assure free movement, the stitch stroke is caused to occur very rapidly so that the percentage of time the quilt layers are "trapped" by the needle and hold down plate 50 is very short. This can be accomplished by assuring that the motor/brake assembly uses an abundantly powered motor and a very rapid braking action, e.g., a DC motor employing an electric shunt for dynamic braking.

Figure 12:
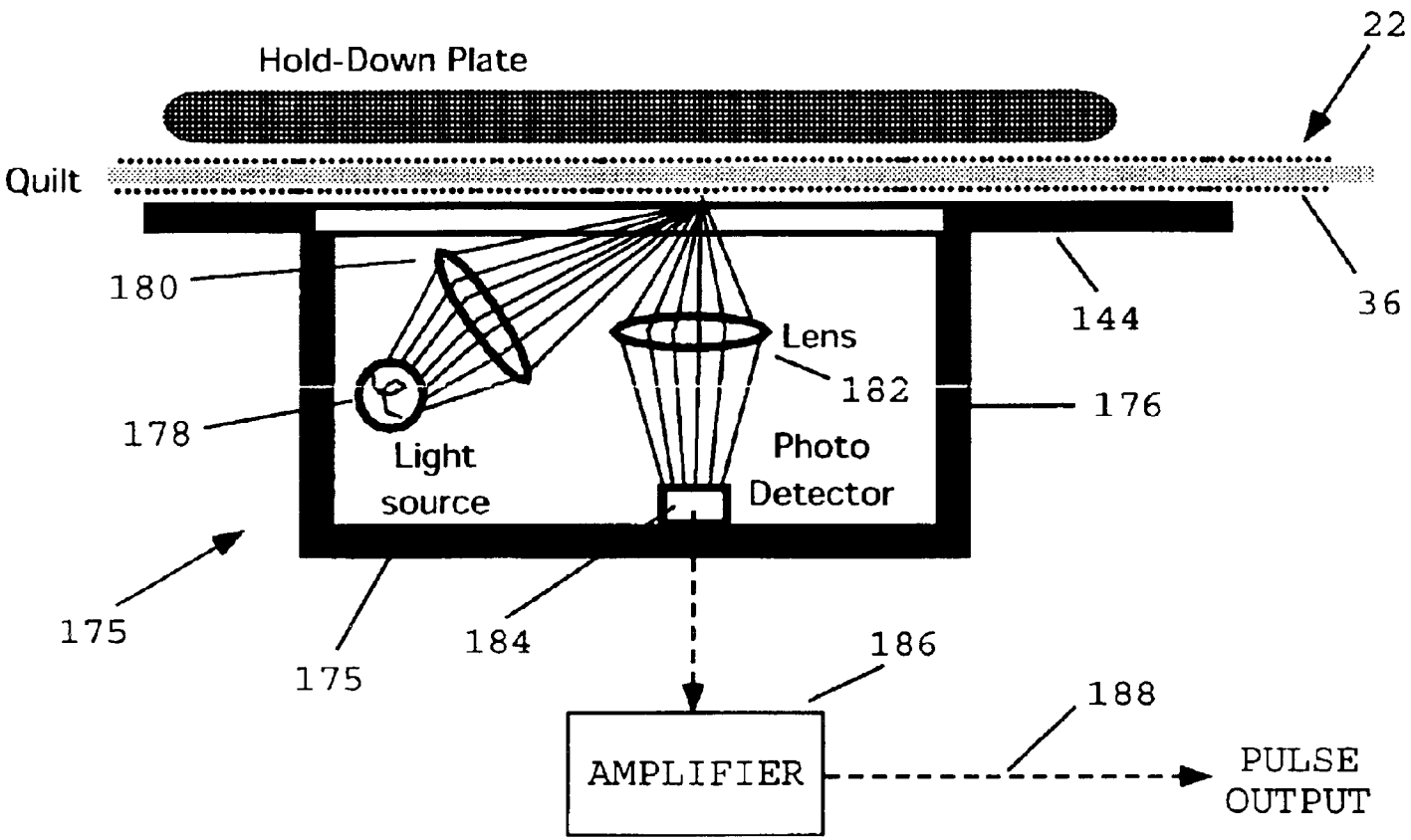
FIG. 12 is a schematic illustration depicting a second alternative optical motion detector for use in the embodiments of FIGS. 2 and 7.

Attention is now directed to FIG. 12 which illustrates an optical motion detector embodiment 175 which is alternative to the embodiment 64 shown in FIG. 8. It will be recalled that the embodiment of FIG. 8 operates by capturing a sequence of images and then comparing those images to detect motion of the quilt backing layer 36. The embodiment 175 of FIG. 12 operates instead to count threads (warp and/or woof) as they cross the focal point of a light beam.

With continuing reference to FIG. 12, note that the detector embodiment 175 is comprised of a housing 176 preferably mounted beneath the bed 144. The housing contains a light source 178 which transmits light through lens system 180 to produce a beam focused against the backing layer 36 of the quilt material stack 22. The reflected light from the backing layer is collected by lens system 182 and coupled to a photodetector 184. The photodetector 184 generates a detectable signal change for each thread crossing the focal point of the beam incident on the backing layer 36. The output of photodetector 184 drives an amplifier 186 to produce a pulse output 188 representing thread crossings, i.e., backing layer motion.

Figure 13:
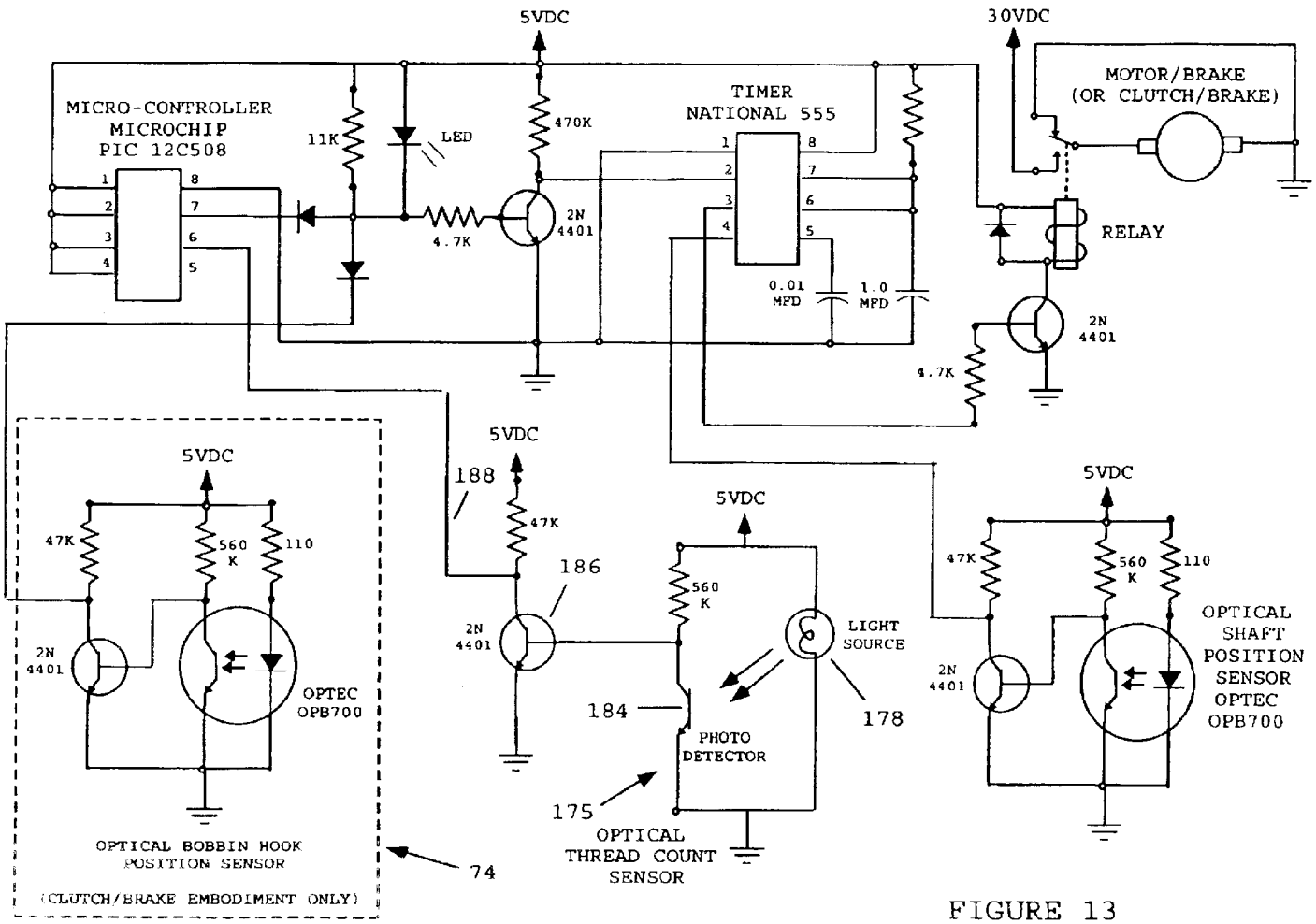
FIG. 13 is a schematic diagram of a control subsystem employing the detector of FIG. 12 for use in the embodiments of FIGS. 2 and 7.

Attention is now directed to FIG. 13 which illustrates a circuit diagram of a control subsystem substantially identical to that shown in FIG. 9 except that it incorporates the optical motion detector 175 of FIG. 12 in lieu of the optical motion detector 64 of FIG. 8. More particularly, note that FIG. 13 shows light source 178 illuminating photodetector 184 which drives amplifier 186 to produce output pulses on lead 188. Lead 188 is connected to the input of the aforediscussed microcontroller 96.

Figure 14:
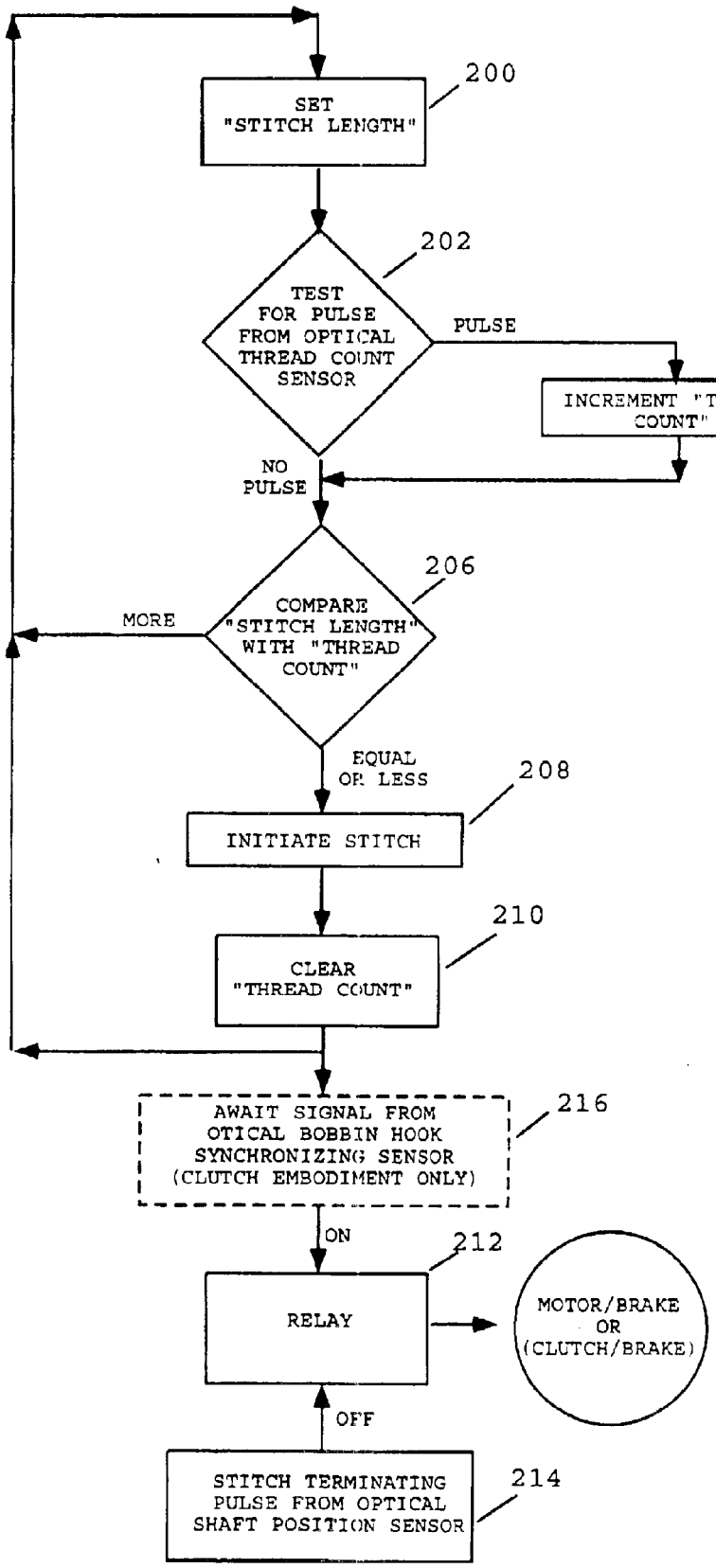
FIG. 14 is a flow chart depicting the operation of the controller of FIG. 13.

Attention is now directed to FIG. 14 which illustrates a flow diagram depicting the algorithmic operation of the microcontroller 96 of FIG. 13 when used in conjunction with the optical motion detector 175. A stitch cycle in accordance with FIG. 14 starts with block 200 which functions to acquire a "stitch length" value. Operation proceeds from block 200 to decision block 202 which looks for a pulse on lead 188 (FIG. 13) from the optical detector 175. If no pulse is detected, operation proceeds directly to decision block 206. If a pulse is detected, operation proceeds to block 204 which increments a stored thread count, prior to proceeding to decision block 206. Block 206 compares the preset stitch length value with the current thread count. If the preset stitch length is greater than the current thread count, then operation loops back to the initial block 200. On the other hand, if the stitch length is equal to or less than the current thread count, then operation proceeds to block 208 to initiate a stitch. In block 210, the current thread count is cleared or reset to zero and operation loops back to the initial block 200. Additionally, after execution of block 210, the output relay 114 is energized in block 212 to actuate the motor/brake assembly 56 or clutch/brake assembly 69. However, as will recalled from the flow diagram of FIG. 10, the termination of block 212 requires a terminating signal from the shaft position sensor 66 (represented by block 214) to indicate that the needle is in its full up position. FIG. 14 also depicts dashed block 216 between blocks 210 and 212. Block 216 is relevant to the embodiment of FIG. 7 and indicates that the execution of block 212 is deferred until receipt of an enabling signal from the hook position sensor 74 shown in FIG. 13.

It is pointed out that FIG. 14 only demonstrates operation in a single stitch, or impulse, mode but it should be understood that alternative embodiments can function solely in a continuous proportional mode or in a dual mode system by incorporating the steps depicted in FIG. 11(B).

Embodiments of the invention can be configured to produce a wide range of uniform stitch lengths. For typical quilting applications, a stitch length of about 2.5 mm (1/10 in.) is considered attractive by a significant segment of the quilting community. In typical use by an exemplary user, it is expected that the stack would be moved on the order of one inch per second which would equate to ten stitches per inch or ten stitches per second (i.e., 100 milliseconds per stitch). In this exemplary situation, if the stitch cycle duration is limited to 50 milliseconds or less, the needle 48 and hold-down plate 50 would capture the stack less than 50% of the time thus providing the user with a sensation of free stack movement.

Although only a limited number of specific embodiments have been described herein, it should be recognized that many further alternative arrangements will occur to those skilled in the art which fall within the spirit of the invention and the intended scope of the appended claims.

Figure 15:
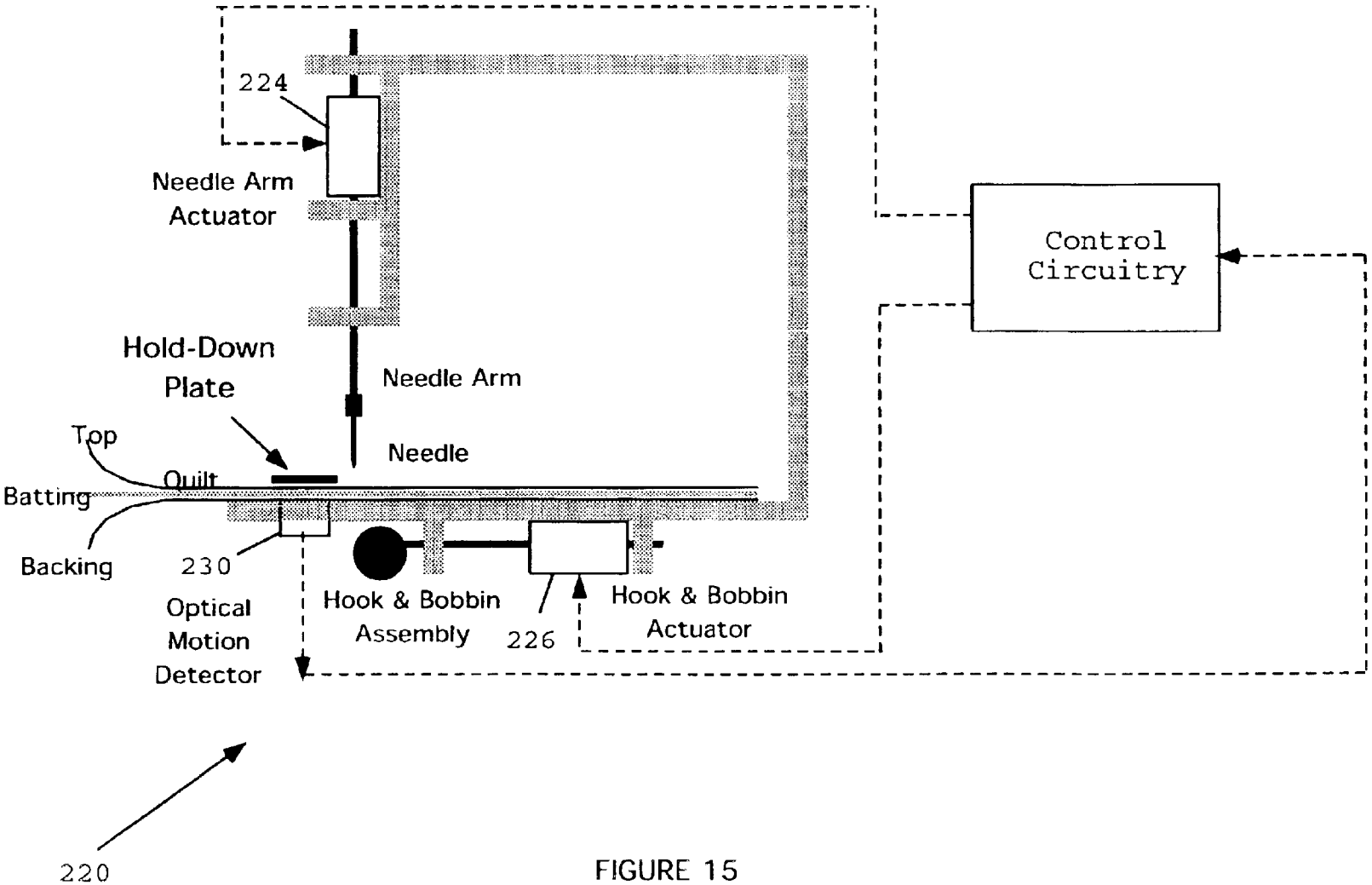
FIG. 15 is a diagrammatic illustration of a third alternative system embodiment.

For example only, FIG. 15 illustrates a third exemplary embodiment 220 alternative to the embodiments of FIGS. 2 and 7. The embodiment 220 differs primarily in that instead of using a common drive train, embodiment 220 uses separate electric actuators 224, 226 for respectively driving the stitch head and hook and bobbin assembly. The actuators 224 and 226 are controlled by control circuitry 228 in response to signals supplied by motion detector 230 representative of stack movement.

Figure 16:
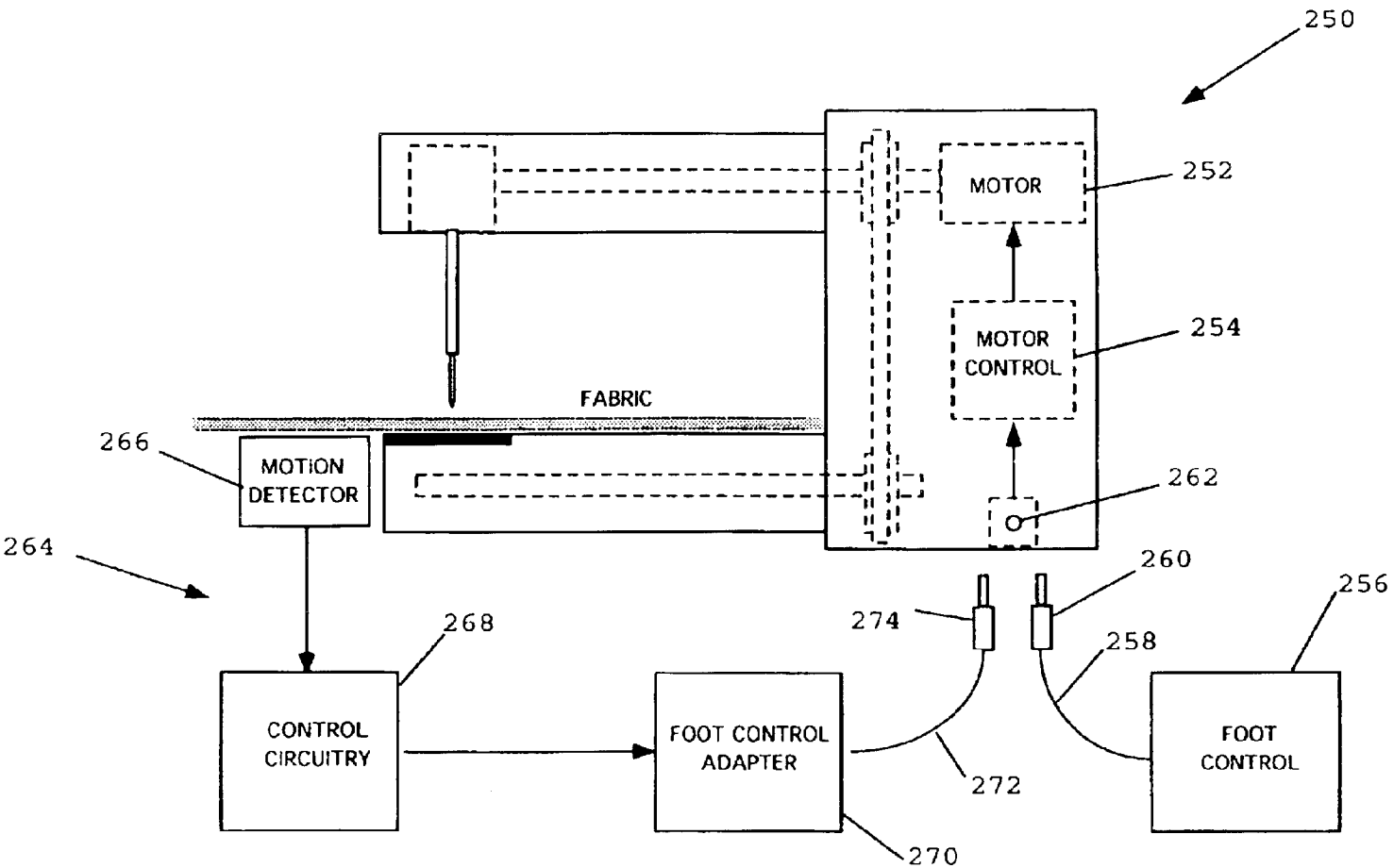
FIG. 16 is a block diagram depicting how a conventional sewing machine can be adapted to incorporate the present invention.

Although the preferred embodiments described herein comprise machines in which the elements of the invention are fully integrated, it is recognized that an alternative embodiment can be provided for after market adapting of a conventional sewing machine to operate in accordance with the invention. More particularly, attention is directed to FIG. 16 which depicts a conventional sewing machine 250 having a drive motor 252. The drive motor is typically controlled by motor control circuitry 254 which can control motor speed and other aspects or motor operation. Motor speed is typically controlled by a user input provided by a foot control 256 via a cable 258 and plug 260 which mates with a connector 262.

A stitch control module 264 in accordance with the present invention is intended to be plugged into connector 262 in place of original foot control 256 to operate the needle at a rate proportional to movement of a fabric stack. The module 264 is comprised of a motion detector 266, as previously discussed, mounted to measure stack movement within the throat space of machine 250. The detector 266 is connected to control circuitry 268 which drives a foot control adapter 270. The adapter 270 is configured to accept speed control input commands from control circuitry 268 and, in turn, output commands, i.e., control signals which simulate those provided by the original foot control 256. The adapter output control signals are coupled via cable 272 to plug 274 for mating with connector 262. Inasmuch as different machines may have different interfaces for coupling the original foot control 256 to the connector 262 and motor control circuit 254, the foot control adapter 270 and plug 274 should be configured to be compatible with the particular sewing machine being adapted.

From the foregoing, it should be understood that the described quilting/sewing apparatus enables a user to manually grasp a fabric layer stack to move it across a planar bed to produce uniform length stitches through the stack. It should be understood that the user could alternatively choose to mount the stack on a simple commercially available frame enabling the user to grasp the frame in order to move the stack across the bed. It is also pointed out that the quilting/sewing machine described herein can be used in a hand guided quilting system having a frame for holding the fabric stack and a moveable carriage for supporting the quilting/sewing machine.

What is claimed is:

1. An apparatus for stitching together two or more stacked planar layers, said apparatus including:

a stitch head mounted at a fixed location and actuatable to insert a stitch through a stack of two or more planar layers located beneath said stitch head;

a substantially horizontally oriented bed for supporting said stack of planar layers for manually guided movement across said bed beneath said stitch head;

detector means for detecting movement of a surface of said stack oriented parallel to said bed and proximate to said stitch head for producing signals representing the magnitude of stack surface movement; and control circuit means responsive to said signals indicating stack surface movement exceeding a certain threshold for actuating said stitch head to insert a stitch through said stack.

2. The apparatus of claim 1 wherein said stitch head includes a needle mounted for reciprocal movement substantially perpendicular to said bed between a full up position and a full down position; and wherein said control circuit means for actuating said stitch head includes means for applying power to said stitch head to cause said needle to traverse one cycle from said full up position to said full down position to said full up position.

3. The apparatus of claim 2 wherein said means for applying power includes a motor/brake assembly operable in a motor mode for moving said needle and a brake mode for stopping movement of said needle.

4. The apparatus of claim 2 wherein said means for applying power includes a motor and a clutch/brake assembly; and wherein said clutch/brake assembly is operable in a clutch mode for coupling said motor to said stitch head for moving said needle and a brake mode to stop movement of said needle.

5. The apparatus of claim 1 wherein said bed defines a flat substantially horizontal surface for supporting said stack of planar layers; and wherein said stitch head includes a needle mounted for movement substantially perpendicular to said bed surface between a full up position and a full down position whereat it pierces said planar layers supported on said bed surface.

6. The apparatus of claim 5 wherein said control circuit means for actuating said head includes means for selectively applying power to said stitch head to cause said needle to move from said full up position to said full down position.

7. The apparatus of claim 6 further including means for returning said needle from said full down position to said full up position.

8. The apparatus of claim 1 wherein said detector means includes a light source for illuminating said stack surface; and means for processing light reflected from said illuminated stack surface for determining the magnitude of movement of said stack surface.

9. The apparatus of claim 1 wherein said detector means includes optical means for measuring movement of said stack surface along orthogonal X and Y axes; and signal processing means responsive to said measured movement for determining the magnitude of resultant movement of said stack; and wherein said control circuit means actuates said stitch head when the magnitude of said resultant movement exceeds a predetermined stitch length.

10. A machine for stitching at least one fabric layer, said machine comprising:

an upper arm and a lower arm mounted in vertically spaced substantially parallel relationship to define a throat space therebetween;

a substantially horizontally oriented plate on said lower arm for supporting said fabric layer for guided movement in said throat space;

a needle arm supported from said upper arm above said plate actuatable to insert a stitch into said fabric layer;

a detector for detecting movement of a surface of said fabric layer oriented parallel to said plate and in said throat space; and control circuitry responsive to detected movement of said fabric layer surface for controlling actuation of said needle arm.

11. The machine of claim 10 wherein said detector operates to produce X and Y signals respectively representing the magnitude of translational movement of said fabric layer surface along perpendicular X and Y axes.

12. The machine of claim 10 wherein said detector operates to detect movement of said fabric layer surface without physically contacting said fabric layer.

13. The machine of claim 10 wherein said detector includes:

a window oriented to collect energy from said fabric layer surface oriented parallel to said plate; and signal processing means responsive to energy collected by said window for producing signals representing the magnitude of movement of said fabric layer across said plate.

14. The machine of claim 13 wherein said detector includes a source of energy for illuminating said fabric layer surface to reflect energy into said window.

15. The machine of claim 14 wherein said source of energy comprises a light source and said window collects light images reflected from said fabric layer surface.

16. The machine of claim 13 wherein said produced signals represent translational movement of said fabric layer surface along perpendicular X and Y axes.

17. The machine of claim 10 wherein said needle arm includes a needle mounted for cyclic movement between an up position spaced from said plate and a down position piercing said fabric layer proximate to said plate; and wherein said control circuitry is actuatable for moving said needle through at least one cycle comprising needle motion from said up position to said down position to said up position.

18. The machine of claim 17 wherein said control circuitry includes a needle drive means for moving said needle through a cyclic movement in response to a certain magnitude of fabric layer movement detected by said detector.

19. The machine of claim 18 further including user means for adjusting the value of said certain magnitude.

20. The machine of claim 17 wherein said control circuitry includes a needle drive means for repeatedly cyclically moving said needle at a rate related to the speed of fabric layer surface movement detected by said detector.

21. A quilting apparatus for inserting stitches of uniform length through a stack of one or more fabric layers, said apparatus comprising:

a stitch head;

a bed defining a substantially horizontally oriented planar surface mounted opposite to said stitch head, said planar surface being configured to support said stack for guided movement across said planar surface;

said stitch head including a needle operable to execute a cyclic movement from an up position remote from said planar surface to a down position piercing said stack on said planar surface, and back to said up position;

a detector defining a window for collecting energy from a target area substantially coincident with a surface of said stack oriented parallel to said planar surface;

signal processing means responsive to said collected energy for indicating the magnitude of stack translational movement across said planar surface; and control means responsive to a translational movement of said stack of a magnitude exceeding a certain threshold for causing said needle to execute said cyclic movement.

22. The quilting apparatus of claim 21 wherein said detector includes:

a light source mounted to illuminate said stack surface in said target area; and wherein said window is oriented to collect light images reflected from said target area.

23. A method of forming successive stitches of uniform length through a stack of fabric layers having top and bottom surfaces, said method comprising:

mounting an actuatable stitch head at a fixed location;

manually moving said stack of fabric layers across a horizontal planar surface under said stitch head;

detecting the movement of at least one of said stack surfaces oriented parallel to said horizontal planar surface proximate to said stitch head; and actuating said stitch head in response to a certain magnitude of detected stack movement to insert a stitch through said stack of fabric layers.

24. The method of claim 23 wherein said step of mounting said stitch head includes mounting a needle for cyclic vertical movement between an up position spaced from said stack and a down position penetrating said stack moving across said planar surface.

25. The method of claim 23 wherein said step of detecting the movement of said stack includes:

providing an energy source for illuminating a target area of a surface of said stack;

collecting energy images reflected from said target area; and processing said collected energy images to determine the magnitude of movement of said stack.

26. The method of claim 23 wherein said step of actuating said stitch head includes moving said needle through a single cyclic movement in response to each increment of stack movement greater than said certain magnitude.

27. The method of claim 23 wherein said step of actuating said stitch head includes repeatedly cyclically moving said needle at a rate related to the speed of stack movement.

28. A method of forming successive stitches of uniform length through a stack of one or more fabric layers having top and bottom surfaces, said method comprising:

providing a horizontally oriented planar surface for supporting said stack for guided movement across said planar surface;

mounting a stitch head opposite to said planar surface where said stitch head is selectively actuatable to insert a stitch through said stack layers;

manually moving said stack across said planar surface;

optically observing a target area coincident with one of said stack surfaces oriented parallel to said planar surface to determine the magnitude of stack movement proximate to said planar surface; and responding to a magnitude of movement greater than a certain threshold for actuating said stitch head to insert a stitch into said stack.

29. The method of claim 28 wherein said step of moving said stack comprises a user manually grasping said fabric layers to push/pull said stack across said planar surface.

30. The method of claim 28 wherein said stack is mounted on a frame; and wherein said step of moving said stack comprises a user manually grasping said frame to push/pull said stack across said planar surface.

31. A quilting apparatus for inserting stitches into a stack of one or more fabric layers, said apparatus comprising:

a stitch head;

a bed defining a substantially horizontally oriented planar surface mounted opposite to said stitch head, said planar surface being configured to support said stack for guided movement of said stack across said planar surface;

said stitch head including a needle operable to insert a stitch into said stack by executing a cyclic movement including a needle-up position remote from said planar surface and a needle-down position piercing said stack proximate to said planar surface;

a detector for measuring the movement of said stack across said planar surface proximate to said stitch head; and control means for causing said needle to execute cyclic movements at a rate substantially proportional to the rate of stack movement measured by said detector.

32. The apparatus of claim 31 wherein said detector operates to measure the magnitude of translational movement of said stack along orthogonal directions.

33. The apparatus of claim 32 wherein said control means causes said needle to execute one cyclic movement for each threshold unit of movement measured by said detector.

34. The apparatus of claim 31 wherein said stack of fabric layers includes an exterior stack surface; and wherein said detector measures stack movement by measuring translational movement of said exterior stack surface.

* * * * *

(12) INTER PARTES REVIEW CERTIFICATE (118th)

United States Patent
Koerner

(10) Number: US 6,883,446 K1
(45) Certificate Issued: Jan. 15, 2016

(54) QUILTING METHOD AND APPARATUS

(75) Inventor: Ralph J. Koerner

(73) Assignee: BERNINA INTERNATIONAL AG

Trial Numbers:

IPR2013-00364 filed Jun. 17, 2013
IPR2014-00270 filed Dec. 18, 2013

Petitioners: Handi Quilter, Inc.; Tacony Corporation

Patent Owner: Bernina International AG

Inter Partes Review Certificate for:

Patent No.: 6,883,446
Issued: Apr. 26, 2005
Appl. No.: 10/776,355
Filed: Feb. 11, 2004

The results of IPR2013-00364 and IPR2014-00270 are reflected in this inter partes review certificate under 35 U.S.C. 318(b).

INTER PARTES REVIEW CERTIFICATE
U.S. Patent 6,883,446 K1
Trial No. IPR2013-00364
Certificate Issued Jan. 15, 2016

AS A RESULT OF THE INTER PARTES REVIEW PROCEEDING, IT HAS BEEN DETERMINED THAT:

Claims 1, 2, 5-29 and 31-34 are cancelled.

* * * * *